US011401769B2

(12) United States Patent
Howlett

(10) Patent No.: US 11,401,769 B2
(45) Date of Patent: Aug. 2, 2022

(54) HEAD APPARATUS

(71) Applicant: Sudelac Limited, Aberdeenshire (GB)

(72) Inventor: Paul Howlett, Aberdeenshire (GB)

(73) Assignee: Sudelac Limited, Aberdeenshire (GB)

( * ) Notice: Subject to any disclaimer, the term of this patent is extended or adjusted under 35 U.S.C. 154(b) by 173 days.

(21) Appl. No.: 16/487,397

(22) PCT Filed: Feb. 28, 2018

(86) PCT No.: PCT/GB2018/050512

§ 371 (c)(1),
(2) Date: Aug. 20, 2019

(87) PCT Pub. No.: WO2018/158567

PCT Pub. Date: Sep. 7, 2018

(65) Prior Publication Data

US 2019/0368302 A1 Dec. 5, 2019

(30) Foreign Application Priority Data

Feb. 28, 2017 (GB) ..... 1703263

(51) Int. Cl.

| | |
|---|---|
| ***E21B 33/05*** | (2006.01) |
| ***E21B 33/068*** | (2006.01) |
| ***E21B 34/02*** | (2006.01) |
| *E21B 33/12* | (2006.01) |
| *E21B 33/13* | (2006.01) |

(52) U.S. Cl.

CPC ..... *E21B 33/05* (2013.01); *E21B 33/068* (2013.01); *E21B 34/02* (2013.01); *E21B 33/12* (2013.01); *E21B 33/13* (2013.01)

(58) Field of Classification Search

CPC ..... E21B 33/068; E21B 34/02; E21B 33/05; E21B 33/12; E21B 33/13; E21B 33/16; E21B 33/03; E21B 33/14

USPC ..... 166/291

See application file for complete search history.

(56) References Cited

U.S. PATENT DOCUMENTS

| | | | | |
|---|---|---|---|---|
| 2,713,909 A | | 7/1955 | Baker | |
| 2,786,219 A | | 3/1957 | Meyer | |
| 3,035,640 A | | 5/1962 | Gibson et al. | |
| 3,177,513 A | | 4/1965 | Ellet | |
| 4,290,482 A | | 9/1981 | Brisco | |
| 6,079,074 A | * | 6/2000 | Ellett | B08B 9/055 15/104.062 |

(Continued)

FOREIGN PATENT DOCUMENTS

| | | |
|---|---|---|
| CN | 105317395 | 2/2016 |
| GB | 2340861 A | 3/2000 |

OTHER PUBLICATIONS

International Search Report and Written Opinion for PCT/GB2018/050512 dated May 28, 2018.

*Primary Examiner* — Tara Schimpf
(74) *Attorney, Agent, or Firm* — Workman Nydegger

(57) ABSTRACT

The invention provides an apparatus for dropping at least one object into a wellbore tubular string. The tool comprises a mandrel having an inlet and an outlet. The tool also comprises a movable member comprising a bore for receiving the at least one object. The member is movable relative to the mandrel between a first condition in which the bore is not aligned with the mandrel outlet and a second condition in which the bore is aligned with the mandrel outlet.

22 Claims, 8 Drawing Sheets

(56) References Cited

U.S. PATENT DOCUMENTS

| | | | | |
|---|---|---|---|---|
| 7,007,753 | B2 * | 3/2006 | Robichaux | E21B 17/05 166/177.4 |
| 2013/0014949 | A1 | 1/2013 | Robichaux | |
| 2015/0027703 | A1 * | 1/2015 | Zhu | C09K 8/88 166/280.2 |
| 2017/0022777 | A1 * | 1/2017 | Allen | E21B 34/02 |

* cited by examiner

HEAD APPARATUS

CROSS-REFERENCE TO RELATED APPLICATIONS

The present application is a 35 U.S.C. § 371 U.S. National Stage of International Application No. PCT/GB2018/050512, filed on Feb. 28, 2018, which claims priority to Great Britain Patent Application No. 1703263.2, filed Feb. 28, 2017, the entire content of each of which is incorporated herein by reference.

The present invention relates to apparatus for use in the oil and gas industry and in particular to a head apparatus for releasing foam or solid balls, flexible wiper darts and/or wiper plugs and other devices into a wellbore tubular string. A particular aspect of the invention relates to the use of such apparatus in a well cementing operation.

BACKGROUND TO THE INVENTION

In well completion, production and abandonment stages of the life of an oil or gas well, various cementing operations are required in the wellbore. During the construction of an oil or gas well, a well is drilled to a desired depth and liner or casing sections are secured in the wellbore by pumping cement down the inside of the liner or casing and up between the outer surface of the liner or casing and the well formation. Alternatively, cement is placed inside the liner or casing as a plug during abandonment operations.

During the production and abandonment stages cement is used to ensure that the annulus is sealed and to close off well paths.

Once the production of hydrocarbons reduces and the well is no longer economically viable the well is plugged and abandoned by sealing the wellbore casing annulus and inside of casings and liners with cement.

Typically, a cement head is secured to the tubular string at the surface on the rig floor structure to provide a connection between a cement pump and the tubular string that extends into the well. The cement head allows the flow of cement into the well and may contain balls and darts which can be released into the wellbore tubular at appropriate times. The balls and darts may be released before and/or after the pumped cement to provide a boundary between the fluids in the wellbore and the cement. The balls and darts may also wipe the cement from the inner surface of the casing or liner.

However, current cement heads are cumbersome and may result in significant delays for rigging up. They may also provide limitations on the type and quantity of darts or balls that can be released.

SUMMARY OF THE INVENTION

It is an object of an aspect of the present invention to obviate or at least mitigate the foregoing disadvantages of prior art ball, plug or dart dropping apparatus.

It is a further object of an aspect of the present invention to provide a robust and reliable head apparatus which may allow objects such as balls, plugs or darts to be selectively inserted into the head apparatus without requiring dismantling, disconnection and/or replacement of the head apparatus from the tubular string.

It is another object of an aspect of the present invention to provide a head apparatus which is capable of controlling fluid flow into the tubular string during the loading of a ball, plug or dart into the head apparatus.

It is a further object of an aspect of the present invention to provide a head apparatus which is capable of repeatedly receiving and controllably releasing an unlimited number of balls, plugs or darts into a tubular string whilst at the same time controlling fluid flow into the tubular string.

Further aims of the invention will become apparent from the following description.

According to a first aspect of the invention there is provided an apparatus for dropping at least one object into a wellbore tubular string, the apparatus comprising:

a mandrel having an inlet and an outlet;

a movable member comprising a bore for receiving the at least one object;

wherein the member is movable relative to the mandrel between a first condition in which the bore is not aligned with the mandrel outlet and a second condition in which the bore is aligned with the mandrel outlet.

Preferably the apparatus is located on the surface at or above rig floor. Preferably the apparatus is a cement head.

The apparatus may be connectable to a cement head, cement pump and/or a fluid pump located on the surface at or above the rig floor. Preferably the outlet is connectable to a tubular string.

At least one tube may be removeably located within the movable member. The at least one tube may be removeably located within the movable member bore. The at least one tube may contain at least one object. The at least one tube may be positioned into the apparatus allowing at least one object to be loaded quickly and efficiently into the apparatus.

The movable member may be configured to receive at least one tube wherein the at least one tube comprises the at least one object. The at least one tube may be removably located and/or mounted within the bore of the movable member.

The at least one tube containing at least one object may be positioned within the movable member bore when the movable member is in the first condition. The movable member may be configured to allow the at least one tube to be inserted within the bore of the movable member when in the first condition.

The at least one object may be configured to be released from the at least one tube when movable member is in the second condition.

The movable member may comprise a ring, disc, wheel, cylinder, sphere, sleeve, chamber and/or a valve member. The valve member may be selected from a ball, rotary, plug and/or piston valve.

The bore may be a diametric bore. The bore may be a throughbore. The bore may be aligned with a diameter of the movable member. The bore may be substantially parallel with a diameter of the movable member.

The at least one object may be released from the at least one tube under the effects of gravity acting on the at least one object. The at least one object may be configured to be released from the at least one tube under the effects of gravity acting on the at least one object. The at least one object may be released from the at least one tube under the effects of a fluid stream acting on the at least one object.

The at least one object may be released from the at least one tube under the effects of a fluid stream flowing through the mandrel inlet and outlet when the movable member is the second condition. The fluid stream may move the at least one object out of the at least one tube and carry the at least one object into the well.

There may be provided a plurality of removable tubes at surface. The plurality of removable tubes may each contain at least one object.

By providing an apparatus capable of controlling the alignment of a movable member bore and the mandrel outlet it may facilitate the controlled loading and release of an object into the tubular string without the need to disconnect the apparatus from the string or dismantle the apparatus.

By providing an apparatus capable of controlling the alignment of a movable member bore and the mandrel outlet it may facilitate the insertion and release of multiple objects into a well.

The apparatus may facilitate the sequential insertion and release of as many objects as desired for a particular downhole operation. The objects are not required to be held or stored in the apparatus during it installation and/or during pumping operations but may be loaded into the apparatus as required. The apparatus may facilitate the controlled release of unlimited number of objects into the well without the need to disconnect or dismantle the apparatus.

Preferably the movable member is rotatably movable relative to the mandrel. The movable member may be rotatable around a rotational axis transverse to the longitudinal axis of the mandrel. The movable member may be rotatable around a rotational axis perpendicular to the longitudinal axis of the mandrel.

The movable member may be rotatable around a rotational axis transverse to the longitudinal axis of the wellbore tubular string. The movable member may be rotatable in a rotational axis transverse to the direction of fluid flow in the tubular.

Preferably the mandrel inlet and outlet are in alignment. Preferably the mandrel inlet and outlet are in axial alignment. The mandrel inlet, outlet and the bore of the movable member may form a throughbore in the mandrel when the movable member is in the second condition. The movable member may be located between the mandrel inlet and the mandrel outlet.

Preferably the apparatus is connectable to a drill string. The apparatus may be connectable to a drill string on a rig floor at surface downstream from a fluid and/or cement pump.

The mandrel inlet and/or mandrel outlet may be configured to be connected to a tubular string. The mandrel inlet may be configured to be connected to a cement pump and/or a fluid pump, mud pump, cement head and/or a tubular string. The mandrel outlet may be configured to be connected to a drill string or a casing or liner string. The outlet may be connected to a tubular string below a cement pump, cement head and/or fluid pump.

The apparatus may be connectable to a drill string that goes into a well. The apparatus may be connectable to a top drive on the rig floor. This may allow fluids to be pumped down the drill string via the pumps through the top drive and into the well. This may facilitate at least one object inserted into the apparatus to be pumped with the fluid into the well.

The at least one object may be selected from the group comprising a dart, ball, drift, RFID tag or plug. The dart, ball or plug may be selected from the group comprising foam, solid, wiper and/or setting darts, balls or plugs.

The at least one object may be loaded into a removable tube. The at least one object may be pre-loaded into a removable tube prior to use. A plurality of tubes pre-loaded with the at least one object may be stored ready to be inserted into the apparatus.

Preferably the tubular string is a drill string, casing or liner string. The tubular string may be a drill string connected to a casing or liner string.

Preferably the movable member may be rotatably mounted to the mandrel by a housing. The housing may be secured to the mandrel. Preferably, the movable member may be rotatably movable relative to the housing.

The apparatus may comprise a lock mechanism configured to lock the position of the movable member relative to the mandrel and/or the housing.

The movable member may be configured to block the inlet and/or the outlet when in the first and/or second condition. The movable member may be configured to stop flow into the tubular string when in the first and/or second condition. Preferably the movable member is configured to form a seal with the inlet and/or the outlet when in the first condition to stop flow into the tubular string. An outer surface of the movable member may be configured to form a seal with the inlet and/or the outlet when in the first condition. The movable member may be configured to stop flow from above and/or below in the first condition.

When the movable member is in the first position flow is prevented from entering the string from above the apparatus and flow from below is prevented flowing up because the movable member shuts off fluid communication between the mandrel inlet and outlet whilst at least one object may be inserted into the movable member bore. When the movable member is moved to the second position the movable member bore aligns with the inlet and outlet allowing flow entering the string from above the apparatus and/or flow from below the movable member. The flow through the apparatus in the second condition carries the at least one object out of the apparatus into the well.

According to a second aspect of the invention there is provided an apparatus for dropping at least one object into a wellbore tubular string the apparatus comprising:

a mandrel having an inlet and an outlet wherein the inlet is connectable to a cement head, cement pump and/or a fluid pump and the outlet is connectable to a tubular string;

a movable member comprising a bore for receiving the at least one object;

wherein the member is movable relative to the mandrel between a first condition in which the bore is not aligned with the mandrel outlet and a second condition in which the bore is aligned with the mandrel outlet.

Embodiments of the second aspect of the invention may include one or more features of the first aspect of the invention or its embodiments, or vice versa.

According to a third aspect of the invention there is provided an apparatus for dropping at least one object into a wellbore tubular string, the apparatus comprising:

a mandrel having an inlet and an outlet wherein the outlet is connected to a tubular string;

a movable member comprising a bore for receiving the at least one object;

wherein the movable member is movable relative to the mandrel between a first condition in which the bore is not aligned with the mandrel outlet and a second condition in which the bore is aligned with the mandrel outlet.

Embodiments of the third aspect of the invention may include one or more features of the first or second aspects of the invention or their embodiments, or vice versa.

According to a fourth aspect of the invention there is provided an apparatus for dropping at least one object into a wellbore tubular string, the apparatus comprising:

a mandrel having an inlet connected to a cement head, cement pump and/or fluid pump and an outlet connected to a tubular string wherein the outlet in fluid communication with a tubular string;

a movable member comprising a bore for receiving the at least one object;

wherein the member is movable relative to the mandrel between a first condition in which the bore is not aligned with the mandrel outlet and a second condition in which the bore is aligned with the mandrel outlet.

Embodiments of the fourth aspect of the invention may include one or more features of the first to third aspects of the invention or their embodiments, or vice versa.

According to a fifth aspect of the invention there is provided an apparatus for dropping at least one object into a wellbore tubular string, the apparatus comprising:

a mandrel having an inlet and an outlet wherein the outlet is connected to a tubular string below a cement pump, cement head and/or fluid pump;

a movable member comprising a bore for receiving the at least one object;

wherein the member is movable relative to the mandrel between a first condition in which the bore is not aligned with the mandrel outlet and a second condition in which the bore is aligned with the mandrel outlet.

Embodiments of the fifth aspect of the invention may include one or more features of the first to fourth aspects of the invention or their embodiments, or vice versa.

According to a sixth aspect of the invention there is provided an apparatus for dropping at least one object into a wellbore tubular string, the apparatus comprising:

a mandrel having an inlet and an outlet wherein the outlet is connectable to a tubular string;

a cylinder comprising a bore for receiving the at least one object;

wherein the cylinder is movable relative to the mandrel between a first condition in which the bore is not aligned with the mandrel outlet and a second condition in which the bore is aligned with the mandrel outlet.

Embodiments of the sixth aspect of the invention may include one or more features of the first to fifth aspects of the invention or their embodiments, or vice versa.

According to a seventh aspect of the invention there is provided an apparatus for dropping at least one object into a wellbore tubular string, the apparatus comprising:

a mandrel having an inlet connectable to a cement head, cement pump and/or fluid pump and an outlet connectable to a tubular string;

a valve member comprising a passageway configured to receive at least one object to be dropped;

wherein the valve member is movable relative to the mandrel between a first condition in which the passageway is not aligned with the mandrel outlet and a second condition in which the passageway is aligned with the mandrel outlet.

Embodiments of the seventh aspect of the invention may include one or more features of the first to sixth aspects of the invention or their embodiments, or vice versa.

According to an eighth aspect of the invention there is provided an apparatus for dropping at least one object into a wellbore tubular string, the apparatus comprising:

a mandrel having an inlet connected to a cement head, cement pump and/or fluid pump and an outlet connected to a tubular string;

a valve member comprising a passageway configured to receive at least one object to be dropped;

wherein the valve member is movable relative to the mandrel between a first condition in which the passageway is not aligned with the mandrel outlet and a second condition in which the passageway is aligned with the mandrel outlet.

Embodiments of the eighth aspect of the invention may include one or more features of the first to seventh aspects of the invention or their embodiments, or vice versa.

According to a ninth aspect of the invention there is provided a cement head apparatus for dropping at least one object into a wellbore tubular string, the apparatus comprising:

a mandrel having an inlet and an outlet wherein the outlet is connectable to a tubular string;

a movable member comprising a passageway configured to receive at least one object to be dropped;

wherein the member is movable relative to the mandrel between a first condition in which the passageway is not aligned with the mandrel outlet and a second condition in which the passageway is aligned with the mandrel outlet.

Embodiments of the ninth aspect of the invention may include one or more features of the first to eighth aspects of the invention or their embodiments, or vice versa.

According to a tenth aspect of the invention there is provided a method of dropping at least one object into a wellbore tubular string, the method comprising:

providing a head apparatus connected to a tubular string;

the head apparatus comprising a mandrel having an inlet and an outlet wherein the outlet is connected to the tubular string;

a movable member comprising a bore;

inserting at least one object into the bore; and moving the member relative to the mandrel between a first condition in which the bore is not aligned with the mandrel outlet and a second condition in which the bore is aligned with the mandrel outlet.

The method may comprise moving the movable member from the second condition to the first condition prior to inserting at least one object into the bore.

The method may comprise rotating the movable member relative to the mandrel between a first condition in which the bore is not aligned with the mandrel outlet and a second condition in which the bore is aligned with the mandrel outlet.

The method may comprise rotating the movable member about a rotational axis transverse to the longitudinal axis of the mandrel. The method may comprise rotating the movable member about a rotational axis transverse to the longitudinal axis of the tubular string. The method may comprise rotating the movable member about a rotational axis transverse to the longitudinal axis of the fluid flow.

The inlet may be connected to a cement head, cement pump and/or a fluid pump. The method may comprise stopping fluid flow into the inlet prior to moving the movable member relative to the mandrel between a first condition in which the bore is not aligned with the mandrel outlet and a second condition in which the bore is aligned with the mandrel outlet.

The method may comprise locking the movable member in the first condition and/or the second condition.

The method may comprise blocking the inlet and outlet when the movable member is in the first position.

The method may comprise inserting the at least one object into the bore through an access port. The method may comprise blocking and/or sealing the access port when the movable member is in the second position.

The method may comprise pumping fluid into the inlet, movable member bore and through the outlet subsequent to moving the movable member to the second condition.

The method may comprise visually inspecting the movable member bore to confirm the at least one object has been released and dropped.

The method may comprise moving the movable member from a second condition to a first position to visually inspect the movable member bore to confirm the at least one object has been released and dropped.

Embodiments of the tenth aspect of the invention may include one or more features of the first to ninth aspects of the invention or their embodiments, or vice versa.

According to an eleventh aspect of the invention there is provided a method of dropping at least one object in a wellbore tubular string, the method comprising:

providing a head apparatus connected to a tubular string;

the head apparatus comprising a mandrel having an inlet and an outlet wherein the outlet is connected to the tubular string;

a movable member comprising a bore;

inserting at least one object into the bore while the movable member is in a first condition in which the bore is not aligned with the mandrel outlet; and moving the member relative to the mandrel to a second condition in which the bore is aligned with the mandrel outlet.

Embodiments of the eleventh aspect of the invention may include one or more features of the first to tenth aspects of the invention or their embodiments, or vice versa.

According to a twelfth aspect of the invention there is provided a method of dropping at least one object in a wellbore tubular string, the method comprising:

providing a head apparatus connected to a tubular string;

the head apparatus comprising a mandrel having an inlet and an outlet wherein the outlet is connected to the tubular string;

a movable member comprising a bore;

moving the member to a first condition in which the bore is not aligned with the mandrel outlet;

inserting at least one object into the bore while the movable member is in a first condition; and moving the member relative to the mandrel to a second condition in which the bore is aligned with the mandrel outlet.

The method may comprise blocking the inlet and/or outlet when the movable member is in the first position.

The method may comprise stopping the pumping of fluid into the inlet prior to moving the movable member to the first condition. The method may comprise pumping fluid into the inlet, movable member bore and through the outlet subsequent to moving the movable member to the second condition.

Embodiments of the twelfth aspect of the invention may include one or more features of the first to eleventh aspects of the invention or their embodiments, or vice versa.

According to a thirteenth aspect of the invention there is provided a method of dropping at least one object into a wellbore tubular string, the method comprising:

providing a head apparatus connected to a tubular string;

the head apparatus comprising a mandrel having an inlet and an outlet wherein the outlet is connected to the tubular string;

a valve member comprising a comprising a passageway;

inserting at least one object into the passageway;

moving the valve member relative to the mandrel between a first condition in which the passageway is not aligned with the mandrel outlet and a second condition in which the passageway is aligned with the mandrel outlet.

Embodiments of the thirteenth aspect of the invention may include one or more features of the first to twelfth aspects of the invention or their embodiments, or vice versa.

According to a fourteenth aspect of the invention there is provided a method of performing a cementing operation, the method comprising:

providing a head apparatus connected to a tubular string;

the head apparatus comprising a mandrel having an inlet connected to a cement pump and an outlet connected to a tubular string;

a movable member comprising a bore;

inserting at least one object into the bore; and moving the member relative to the mandrel between a first condition in which the bore is not aligned with the mandrel outlet and a second condition in which the bore is aligned with the mandrel outlet.

The method may comprise pumping cement into the inlet, movable member bore and through the outlet subsequent to moving the movable member to the second condition.

The method may comprise visually inspecting the movable member bore to confirm the at least one object has been released and dropped.

The method may comprise moving the member back to the first condition and inserting a further object into the bore. The method may comprise moving the member to the second condition to drop the further object into the tubular string.

Embodiments of the fourteenth aspect of the invention may include one or more features of the first to thirteenth aspects of the invention or their embodiments, or vice versa.

According to a fifteenth aspect of the invention there is provided a method of installing a head apparatus on tubular string;

the method comprising providing a head apparatus;

the head apparatus comprising a mandrel having an inlet and an outlet;

a movable member comprising a bore configured to receive at least one object;

wherein the member is movable relative to the mandrel between a first condition in which the bore is not aligned with the mandrel outlet and a second condition in which the bore is aligned with the mandrel outlet; and connecting the outlet to a tubular string.

Embodiments of the fifteenth aspect of the invention may include one or more features of the first to fourteenth aspects of the invention or their embodiments, or vice versa.

According to a sixteenth aspect of the invention there is provided a kit of parts comprising: at least one object to be dropped into a wellbore tubular string and an apparatus for dropping at least one object into a wellbore tubular string, the apparatus comprising:

a mandrel having an inlet and an outlet;

a movable member comprising a bore configured to receive at least one object;

wherein the member is movable relative to the mandrel between a first condition in which the bore is not aligned with the mandrel outlet and a second condition in which the bore is aligned with the mandrel outlet.

The at least one object may be selected from the group comprising a dart, ball or plug. The dart, ball or plug may be selected from the group comprising foam, solid, wiper and/or setting darts, balls or plugs.

Embodiments of the sixteenth aspect of the invention may include one or more features of the first to fifteenth aspects of the invention or their embodiments, or vice versa.

BRIEF DESCRIPTION OF THE DRAWINGS

There will now be described, by way of example only, various embodiments of the invention with reference to the drawings, of which.

DETAILED DESCRIPTION OF PREFERRED EMBODIMENTS

The head apparatus in this example is configured to be connected to a drill string. It will be appreciated that this is only an example use and the head apparatus may be used in other applications.

Figure 1A:
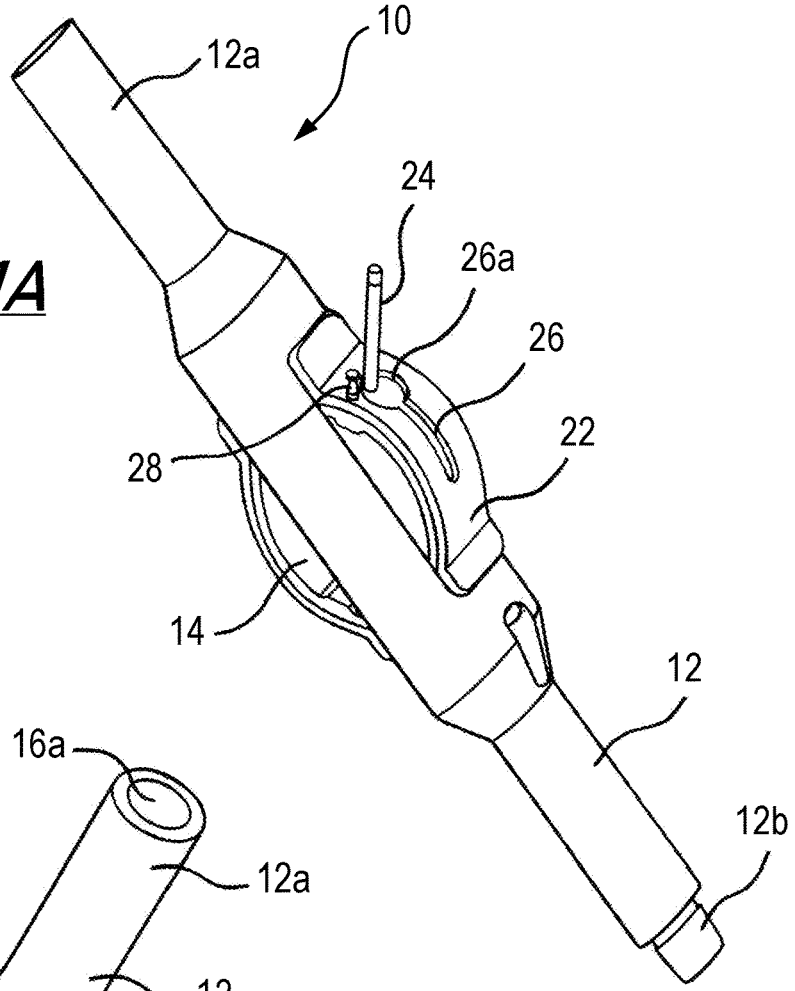
FIGS. 1A and 1B are perspective views of the head apparatus in a fluid flow through condition according to a first embodiment of the invention.
Figure 1B:
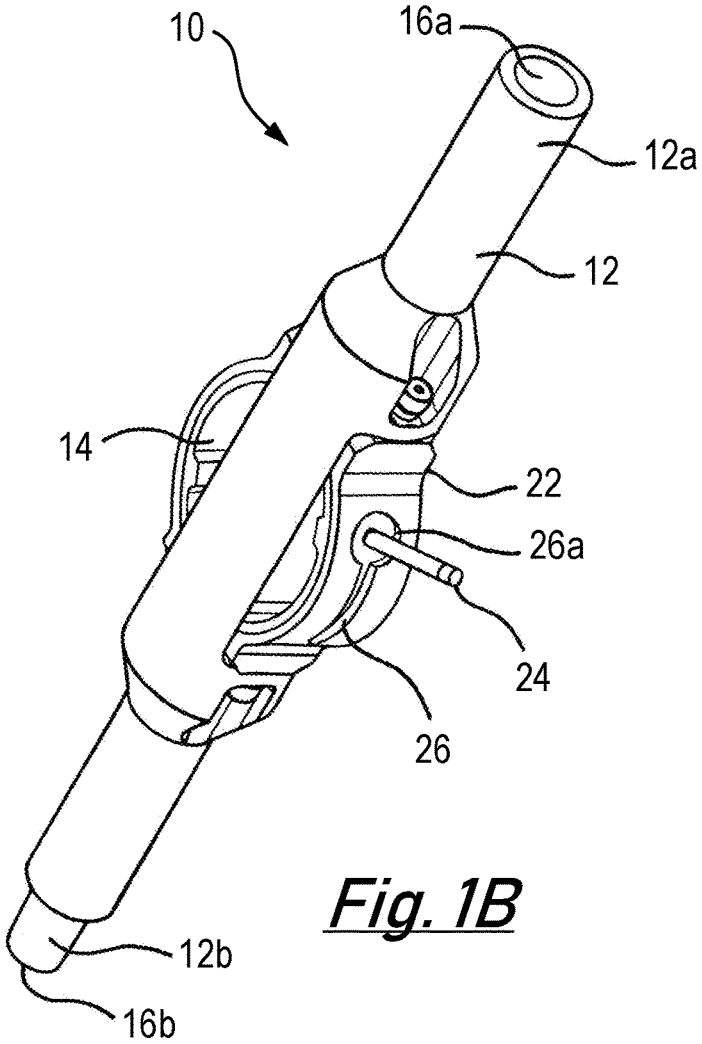

FIGS. 1A and 1B are perspective views of a head apparatus 10 in accordance with a first embodiment of the invention. The tool apparatus 10 comprises a mandrel 12 and a movable member 14. In this example the movable member is a wheel 14.

A mandrel outlet 12*b* is configured to be coupled to a drill string by connectors (not shown). A mandrel inlet 12*a* is configured to be coupled to a cement pump or fluid pump via a top drive or pump-in sub device by connectors (not shown). In alternative arrangements, the head apparatus may be located between drill pipe joints at the rig floor surface.

The mandrel inlet 12*a* comprises a bore 16*a* through which fluid such as cement or mud is configured to be pumped into the head apparatus 10. The mandrel outlet 12*b* comprises a bore 16*b* through which an object and/or a fluid such as cement or mud is configured to be dropped or pumped into the drill string.

The wheel 14 has a bore 20. The bore 20 is a throughbore along the diameter of the wheel. The wheel 14 is configured to be moved between a first condition and a second condition. In this example the wheel is rotatably moved between the first condition and a second condition. The wheel 14 is rotatable in a rotational axis which is transverse to the longitudinal axis of the mandrel as shown by arrow "A" in FIG. 2A.

Figure 2A:
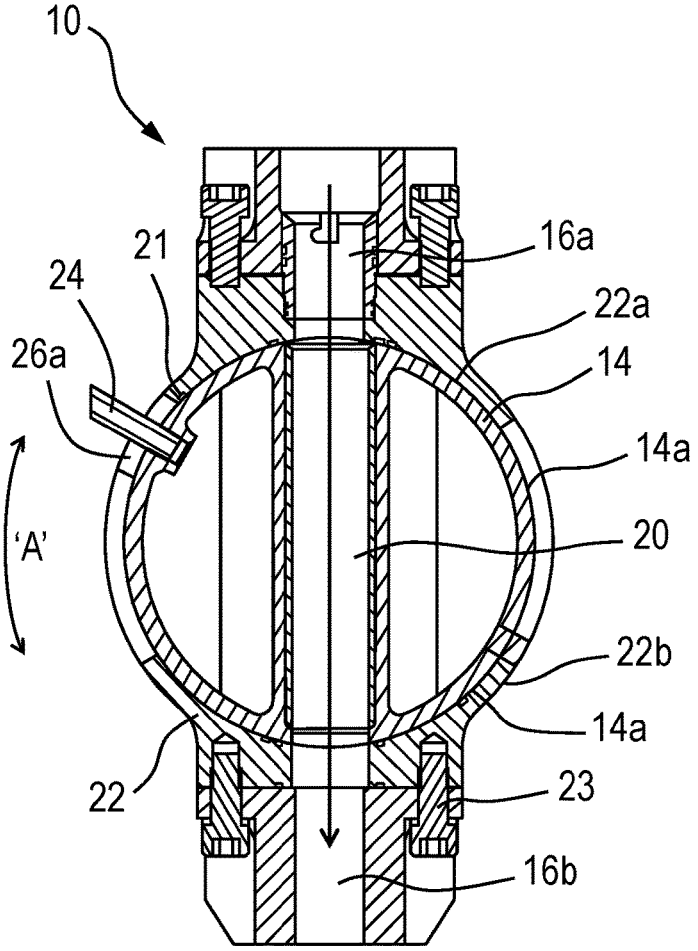
FIG. 2A is a sectional view through the head apparatus of FIG. 1.

In a second position, best shown in FIG. 2A, the bore 20 is aligned and in fluid communication with the bore 16*b* of the outlet 12*b*. In a first position, best shown in FIG. 2C, the bore 20 is not in alignment with the bore 16*b* of the outlet 12*b*.

The wheel 14 is rotatably mounted to the tool 10 via a housing 22. Although, in the present example threaded fastenings 23 such as bolts are used to secure the housing 22 to the mandrel 12, alternative affixing techniques that are removable for disassembly may be used if the design is suitable.

The housing 22 has an inner bearing surface 22*a* and an outer surface 22*b*. The inner bearing surface 22*a* of the housing has a surface profile which corresponds with the outer surface 14*a* of the wheel 14. The inner bearing surface 22*a* of the housing is designed to allow the surface of the wheel 14*a* to pass over the inner surface inner bearing surface 22*a* during movement of the wheel 14.

Seals 21 are provided between the inner bearing surface 22*a* of the housing and the outer surface 14*a* of the wheel 14 to prevent fluid egress between the housing 22 and the wheel 14.

A handle 24 is mounted on the outer surface 14*a* of the wheel to control the rotation of the wheel. The housing has a slot 26 to allow the controlled movement of handle 24. The slot may be shaped and/or dimensioned to limit the rotation of the wheel.

The slot 26 may be dimensioned such that the handle 24 may not be moved beyond the first and second positions. In this example the first and second positions are 45 degrees apart. However, the wheel, handle and housing may be designed such that the handle is required to move through any appropriate or desired angle to move between a first and second position or condition.

Operation of the apparatus will now be described with reference to FIGS. 2A to 4B.

FIG. 2A shows an enlarged sectional view of the apparatus 10 in a fluid flow through configuration. The bore 20 of the wheel is aligned with the outlet bore 16*b* of the mandrel allowing fluid such as cement or mud to pass through the apparatus and into drill string connected to the outlet 12*b* of the mandrel.

Figure 2B:
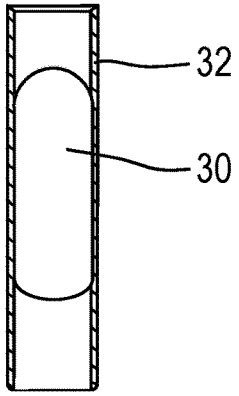
FIG. 2B is a sectional view of a foam ball in a release tube prior to loading into the head apparatus of FIG. 2A.

When it is desired to drop a ball into the drill string a foam ball 30 is provided in a tube 32 as shown in FIG. 2B. The fluid pump (not shown) connected to the mandrel inlet 12*a* is stopped. The handle 24 is moved in an anti-clockwise direction as represented by arrow "F" in FIG. 2C which moves the wheel 14 to a first position where the bore 20 is not in alignment with the bore 16*b* of the outlet 12*b*. In this first wheel position the outer surface 14*a* of the wheel blocks bore 16*a* of the mandrel 14*a* and bore 16*b* of the mandrel 14*b* preventing flow into and out of the drill string.

Figure 2C:
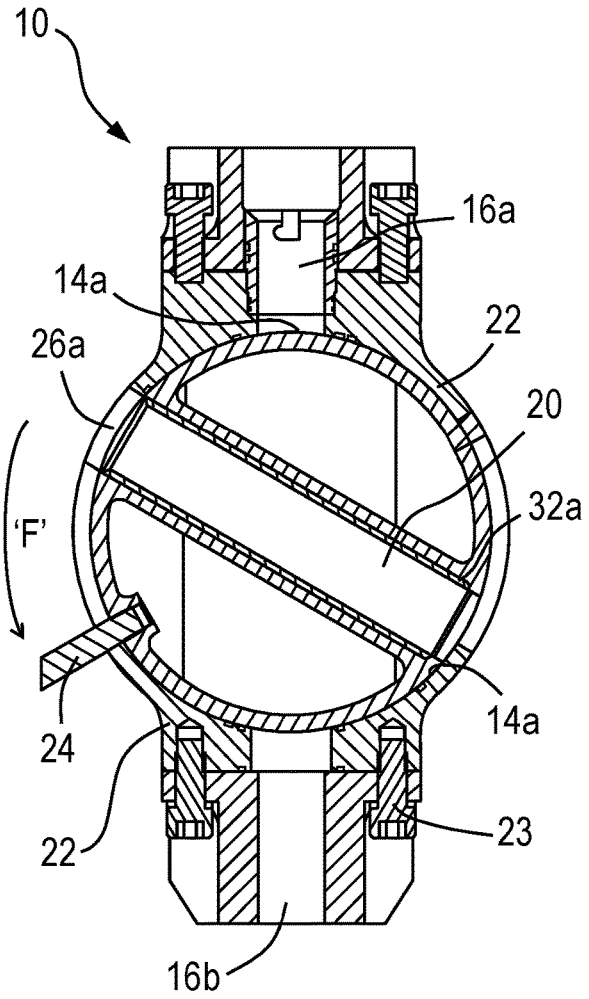
FIG. 2C is a sectional view through the head apparatus of FIG. 2A in a ball loading condition.
Figure 2D:
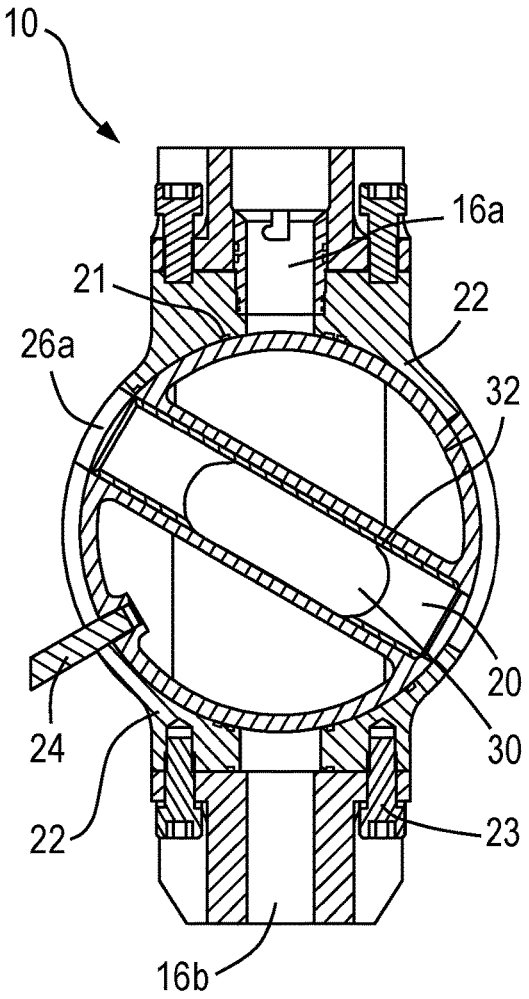
FIG. 2D is a sectional view through the head apparatus of FIG. 2A with the foam ball in a tube of FIG. 2B loaded in the apparatus.

In this first wheel position the bore 20 is aligned with port 26*a* in the housing 22. An empty tube 32*a* located in the bore 20 is removed through the port 26*a* and a tube 32 containing the foam ball 30 is positioned in the bore 20 through the port 26*a* as shown in FIGS. 2C and 2D.

Figure 2E:
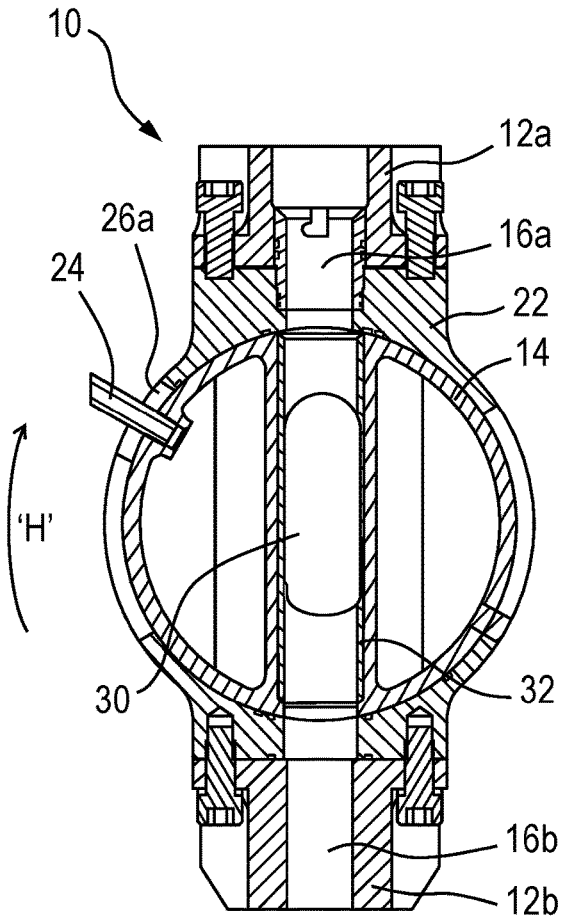
FIG. 2E is a sectional view through the head apparatus of FIG. 2D in a fluid flow through condition.
Figure 2F:
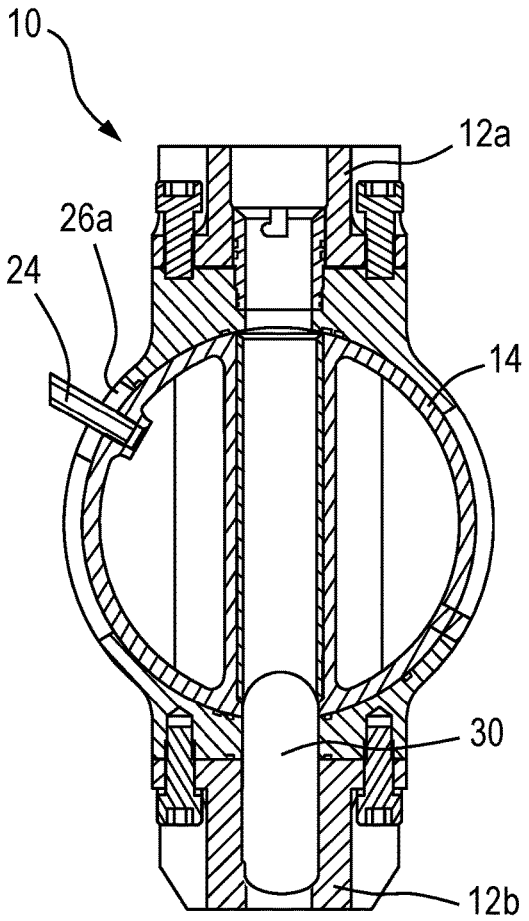
FIG. 2F is a sectional view through the head apparatus of FIG. 2E with the ball released.

The handle 24 is then moved in a clockwise direction as represented by arrow H in FIG. 2E to move the wheel to a second position in which the bore 20 is aligned with the bore 16*b* of the outlet 12*b*. The fluid pump (not shown) connected to the inlet 12*a* of the mandrel 12 is turned on pumping fluid through the bore 16*a* of inlet 12*a* which carries the foam ball 30 in a downward direction into the drill string as shown in FIG. 2F.

The operator can confirm that the ball 30 has been dropped by turning off the pump and moving the handle 24 in an anti-clockwise direction to move the wheel 14 to a first position. The operator may look through the port 26*a* into the bore 20 to visually confirm that the ball has been dropped and is no longer present in the bore 20. This provides an advantage over conventional heads which are pre-loaded with balls or other objects to be dropped. In these prior art tools the object cannot be viewed once the head is connected to the string and therefore do not allow visual confirmation that the object has been dropped. This can result in poorly executed or failed cementing operations.

The steps described above may be repeated as often as required to load and drop multiple objects including balls, darts, drift, RFID tags and/or plugs into the drill string.

Figure 3A:
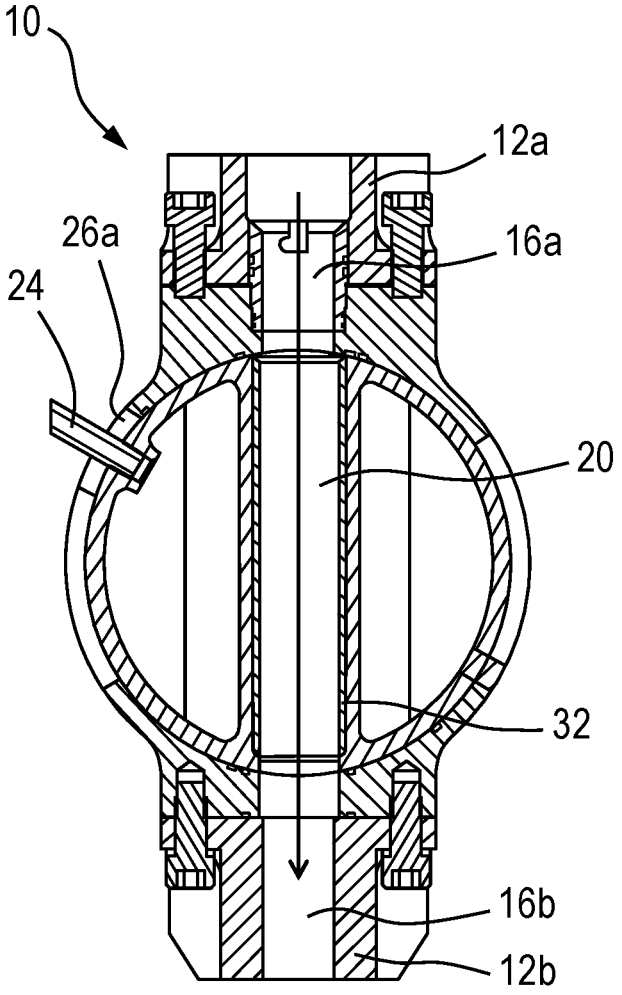
FIGS. 3A to 3E are sectional views of the head apparatus of FIG. 1 in the loading and releasing stages of a dart into a drill string.

FIG. 3A shows an enlarged sectional view of the apparatus 10 in a fluid flow through configuration. The bore 20 of the wheel 14 is aligned with the outlet bore 16*b* of the mandrel 12 allowing fluid such as cement to pass through the apparatus and into a drill string (not shown) connected to the outlet 12*b* of the mandrel.

Figure 3B:
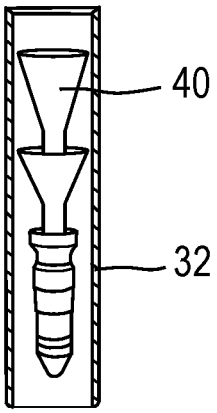

In this example a dart is dropped into the drill string using the apparatus 10. When it is desired to drop a dart into the drill string a tube 32 is provided containing a dart 40 as shown in FIG. 3B. A fluid pump (not shown) connected to the inlet 12*a* of the mandrel 12 is turned off to stop the pumping of fluid in the bore 16*a*.

Figure 3C:
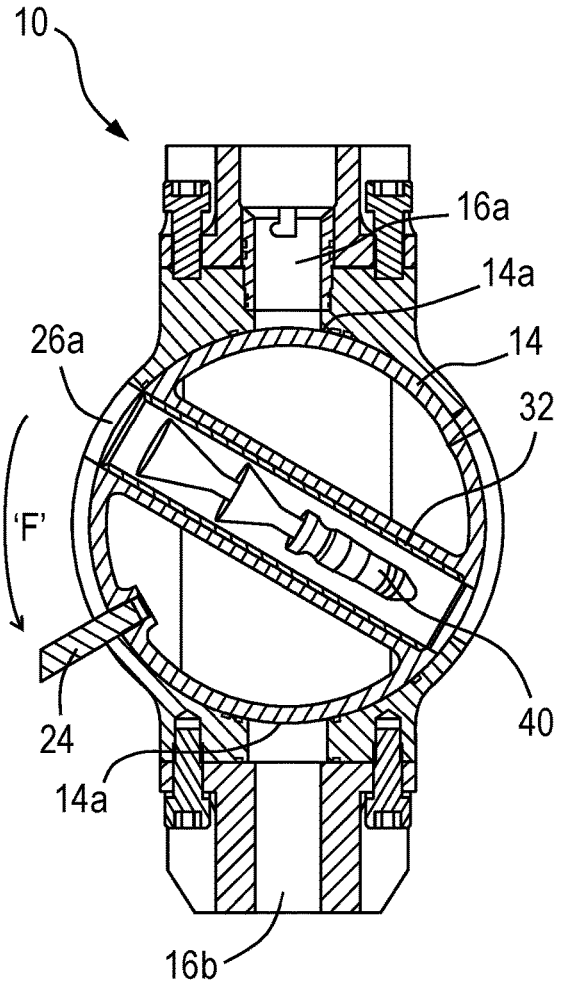

The handle 24 is moved in an anti-clockwise direction as represented by arrow "F" in FIG. 3C which moves the wheel 14 to a first position or condition where the wheel bore 20 is not in alignment with the outlet bore 16*b*.

In this first wheel position the bore 20 is aligned with port 26*a* in the housing 22. An empty tube 32*a* located in the bore 20 is removed through the port 26*a* and a tube 32 containing the dart 40 is positioned in the bore 20 through the port 26*a* as shown in FIG. 3C.

In this first wheel position the outer surface 14*a* of the wheel blocks bore 16*a* of the mandrel 14*a* and bore 16*b* of the mandrel 14*b* preventing flow into and out of the drill string.

Figure 3D:
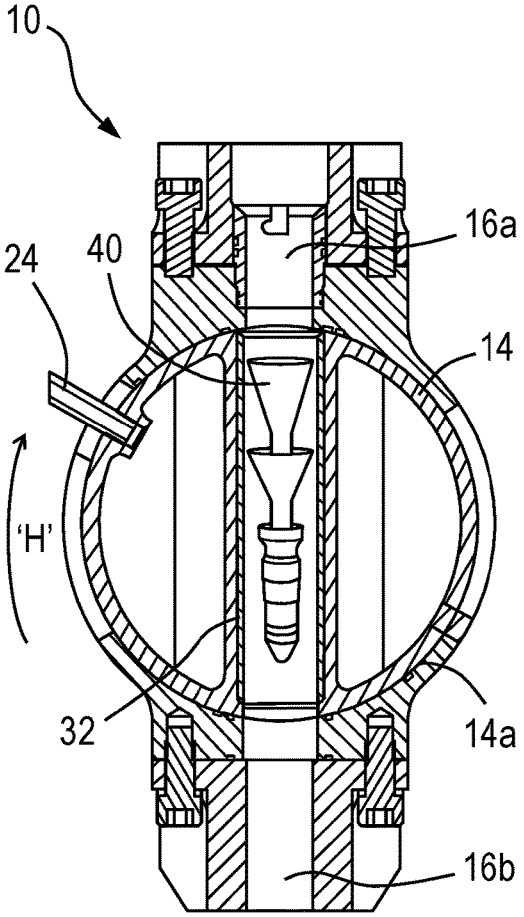
Figure 3E:
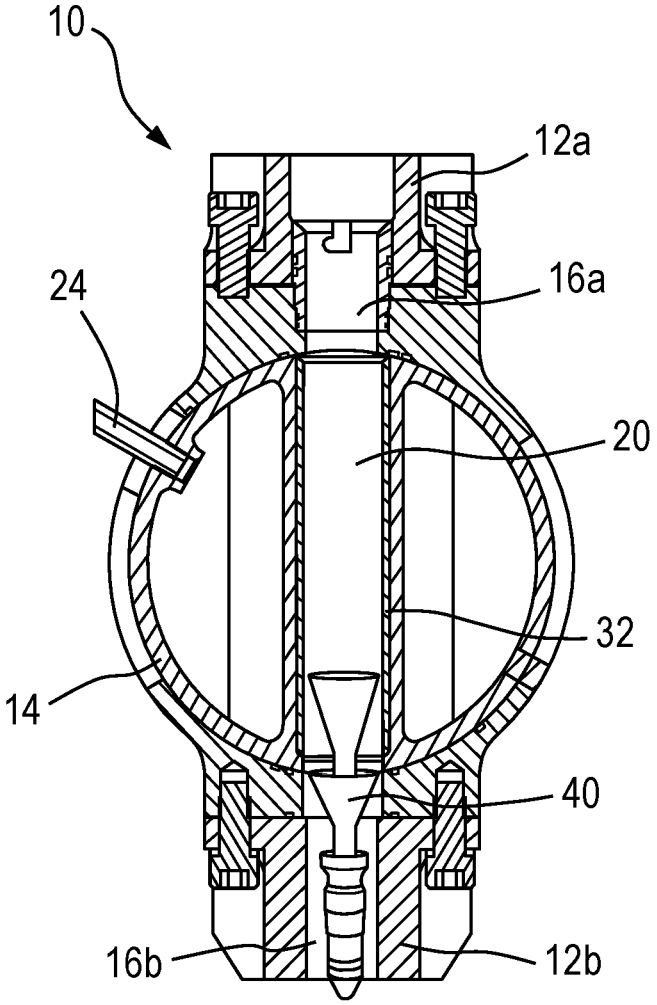

The handle 24 is then moved in a clockwise direction as represented by arrow 'H' in FIG. 3D to move the wheel 14 to a second position in which the bore 20 is aligned with the bore 16*b* of the outlet 12*b*. The fluid pump (not shown) connected to the inlet 12*a* of the mandrel 12 is turned on pumping fluid through the bore 16*a* of inlet 12*a* which carries the dart 40 out of the tube 32 and into the drill string as shown in FIG. 3E.

Figure 4A:
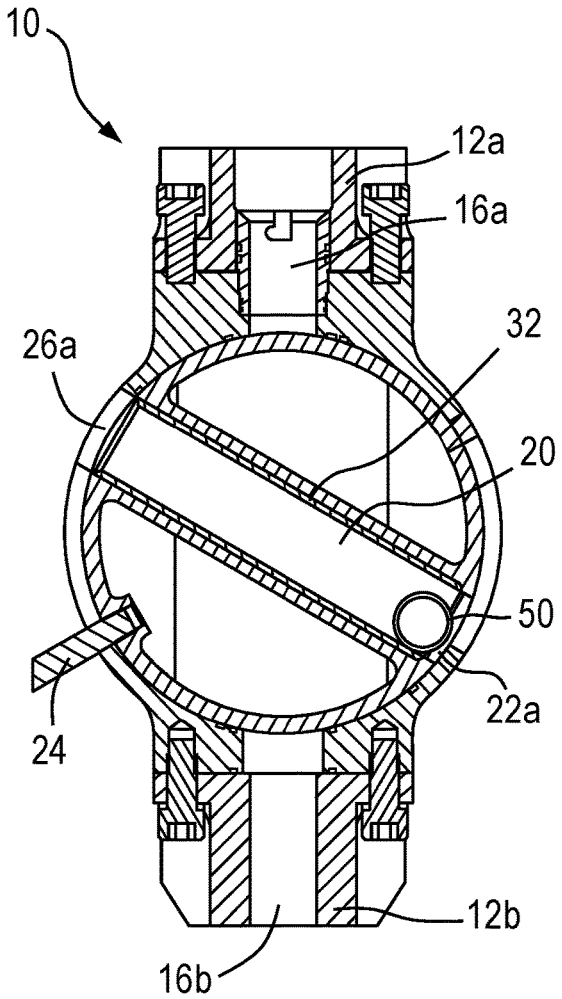
FIGS. 4A and 4B are sectional views of the head apparatus of FIG. 1 in the loading and releasing stages of a setting ball into a drill string.
Figure 4B:
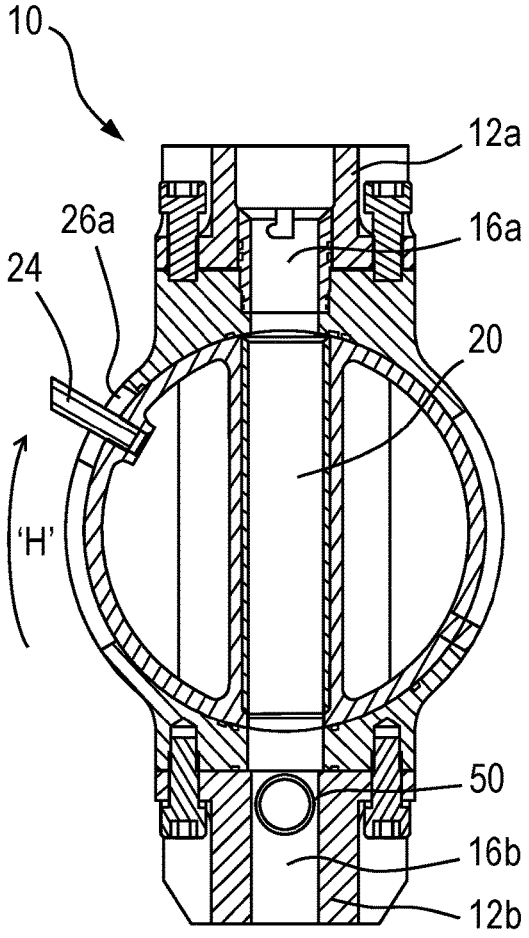

FIGS. 4A and 4B show steps of using the apparatus 10 to drop a setting ball 50 into a drill string.

A fluid pump (not shown) connected to the inlet 12*a* of the mandrel 12 is stopped and the handle 24 is moved in an anti-clockwise direction to move the wheel 14 to a first position where the bore 20 of the wheel is not in alignment with the mandrel outlet bore 16*b*.

In this first wheel position the outer surface 14*a* of the wheel blocks bore 16*a* of the mandrel 14*a* and bore 16*b* of the mandrel 14*b* preventing flow into and out of the drill string.

In this first wheel position the bore 20 is aligned with a port 26*a* in the housing. A setting ball is passed through the port 26*a* and positioned in the empty tube 32 located in the bore 20 as shown in FIG. 4A. The setting ball rests against the inner bearing surface 22*a* of the housing 22.

The handle 24 is then moved in a clockwise direction as represented by arrow "H" in FIG. 4B to move the wheel to a second position in which the bore 20 is aligned with the outlet bore 16*b*. The setting ball passes through the outlet bore 16*b* into the drill string. Alternatively, the ball may be shaped and dimensioned such that it requires fluid pressure to pass into the drill string. The setting ball may move into the drill string when the fluid pump (not shown) connected to the inlet 12*a* of the mandrel 12 is turned on pumping fluid through the apparatus 10.

A lock member 28, best seen in FIG. 1A is configured to engage the outer surface 14*a* of the wheel 14 to maintain the wheel 14 at a particular position relative to the housing 22. The lock member may be located on the housing and may be configured to engage a latch recess on the wheel outer surface. Once the latch member is received in the latch recess the position of the wheel is locked in relation to the housing and the mandrel.

Whilst in the locked condition the wheel cannot be rotated in a clockwise or anti-clockwise direction. This may allow the safe loading or positioning of a ball, dart and/or plugs in the bore 20 of the wheel. This may also prevent movement of the wheel during fluid pumping operations.

The tool apparatus may allow unlimited balls, darts, drift, RFID tags and/or plugs to be loaded and dropped into the drill string.

In the present example, the apparatus is connected to a drill string. However, the tool apparatus may alternatively be connected to a casing directly or liner string via a drill string Although in this example the movable member is a wheel, it will be appreciated that alternative forms of a movable member may be used including a ring, disc, cylinder, sphere, sleeve, chamber and/or a valve member. The valve member may be selected from a ball, rotary, plug and/or piston valve. Further alternative movement member types may be used if the design is suitable.

Throughout the specification, unless the context demands otherwise, the terms 'comprise' or 'include', or variations such as 'comprises' or 'comprising', 'includes' or 'including' will be understood to imply the inclusion of a stated integer or group of integers, but not the exclusion of any other integer or group of integers. Furthermore, relative terms such as", clockwise, anti-clockwise, "lower", "upper, upward, downward, "up" "down" and the like are used herein to indicate directions and locations as they apply to the appended drawings and will not be construed as limiting the invention and features thereof to particular arrangements or orientations.

The invention provides an apparatus for dropping at least one object into a wellbore tubular string. The tool comprises a mandrel having an inlet and an outlet wherein the outlet is connectable to a tubular string. The tool also comprises a movable member comprising a bore for receiving the at least one object. The movable member is movable relative to the mandrel between a first condition in which the bore is not aligned with the mandrel outlet and a second condition in which the bore is aligned with the mandrel outlet.

The present invention obviates or at least mitigates disadvantages of prior art drop tools which pre-load and store the objects to be dropped in the head apparatus or release device while it is being installed and operated. This limits the number of objects that may be preloaded in the device and dropped. The requirement to pre-load these objects can be a disadvantage, especially if the device has to be loaded for a significant amount of time or if the downhole operation changes and the objects need to be replaced or altered. This may require disassembly and reinstallation resulting in costly and inconvenient delays. Current cement heads have devices that attempt to indicate when balls or darts have left the head and entered the work string but it is not possible to see inside the cement head to visually confirm the devices have left. Current cement heads also often have separate manifolds or valves associated with them to control the flow of fluids through them and separate devices that preloaded with a limited number of balls and darts.

The present invention provides a robust and reliable tool which may facilitate the controlled release of wide variety of objects into a wellbore tubular string from the rig floor including plugs, darts, wiper darts and balls (hard or soft). The objects may be shaped and dimensioned such that they are displaced into a pipe under the effects of gravity. The objects may be displaced before, after or during various pumping operations.

The tool may allow limitless numbers of objects such as darts, plugs or balls to be dropped without having to open up the drill pipe, dismantle equipment or disrupt or break any connections.

The present invention avoids the requirement of pre-loading objects such as darts, plugs or balls prior to shipping or installing the tool equipment on a rig. This may avoid delays in rigging up of cumbersome cement heads or other release devices and having to leave darts or balls in a cement head for pro-longed periods.

The present invention is versatile and may be used in combination with drill pipe swages, pump-in swivels and kelly-cocks/TIW valves as required by the planned operation. These components may be connected above or below the tool on the drill string.

The present invention may allow objects such as balls, plugs or darts to be loaded into the tool and released into the pipe as each operation dictates. This mitigates or avoids the requirement to plan in advance the number of balls, darts and/or plugs that must be dropped in a given operation and the sequence they must be dropped.

The present invention may allow complete control over the quantity of objects that are released and the sequence which they are released. The invention also provides the operator with control over the fluid movement in the drill string by providing a head apparatus capable of shutting off flow from below or above the head apparatus during loading of the objects to be dropped. The flow may be shut-off by the same rotational movement required to access the access port to load the object to be dropped in the head apparatus.

The apparatus is easy to operate and only requires one person to move the handle in a first direction to place a loading tube containing the ball, dart or plug into the tool, then lift the handle in an opposing direction allowing the object to be dropped or placing the object into the fluid flow stream when the pumps are activated.

When the handle is pulled down the movable member blocks the inlet bore and the outlet bore of the tool preventing flow into and out of the drill string. This closes off flow from above and below the tool to enable an empty tube to be removed and another object such as a ball, plug, drift, RFID tag or dart to be inserted in to the apparatus.

The present invention allows the operator to confirm that the object has been released by enabling the operator to visually check the bore of the tool for the presence or absence of the object.

The head apparatus is designed to be lower cost, easy to use, lower maintenance and provide no limitation to the number of objects that can be deployed.

The head apparatus may be connected directly onto the top of a drill pipe on the rig floor and drill pipe can also extend above the head apparatus to connect it directly to the top drive on the rig. Pump-in devices may be used under or above the head apparatus.

As the head apparatus has no hydraulic, control or fluid lines attached to it there is no need for it to contain any swiveling sections. The head may be picked up and down and rotated.

The head apparatus may provide a handle connected to the movable member. When the handle is pulled in a generally downward direction an inner part of the head is rotated which moves the bore out of alignment with the inlet and/or outlet. In this first position fluid flow is shut off from above to below the head and prevents back-flow. In this first position an empty tube may be removed from the head apparatus and a new tube containing a device to be dropped, may be placed inside the inner rotatable part of the head apparatus and into the bore. When the handle is lifted in a generally upward direction to a second position where the bore aligns with the inlet and/or outlet and the device can be dropped or pumped away.

A locking mechanism is configured to hold the inner part in the first or second position to stop accidental movement from one position to the other. The tube can be used to hold and/or release anything into the tubular string that can fit in the tube.

The present invention may mitigate or reduce fluid contamination between cement and well fluid and enhance drill pipe cleaning by allowing multiple objects such as foam balls to be released prior to, during and after a cementing operation.

The foregoing description of the invention has been presented for the purposes of illustration and description and is not intended to be exhaustive or to limit the invention to the precise form disclosed. The described embodiments were chosen and described in order to best explain the principles of the invention and its practical application to thereby enable others skilled in the art to best utilise the invention in various embodiments and with various modifications as are suited to the particular use contemplated. Therefore, further modifications or improvements may be incorporated without departing from the scope of the invention herein intended.

The invention claimed is:

1. Apparatus for dropping at least one object into a wellbore tubular string, the apparatus comprising:

a housing comprising an access port;

a mandrel having an inlet and an outlet; and a movable member comprising a bore configured to receive the at least one object;

wherein the member is movable relative to the mandrel between:

a first condition in which the bore is not aligned with the mandrel outlet and the bore is aligned with the access port and is configured to receive the at least one object through the access port; and a second condition in which the bore is aligned with the mandrel outlet and the access port is sealed by the movable member;

wherein the movable member is configured to form a seal with the inlet and/or the outlet when in the first condition; and wherein the movable member is configured to prevent fluid egress through the access port during movement of the movable member between the first condition and the second condition.

2. The apparatus according to claim 1 wherein the apparatus is connectable to a drill sting, a cement head, cement pump, a fluid pump and/or to a top drive on a rig floor.

3. The apparatus according to claim 1 wherein the mandrel outlet is configured to be connected to a tubular string and/or the mandrel inlet is configured to be connected to a fluid pump, cement pump, cement head and/or a tubular string.

4. The apparatus according to claim 1 wherein the movable member is configured to receive at least one tube wherein the at least one tube comprises the at least one object.

5. The apparatus according to claim 4 wherein the at least one tube is removably located and/or mounted within the bore of the movable member.

6. The apparatus according to claim 4 wherein the movable member is configured to allow the at least one tube to be inserted within the bore of the movable member when in the first condition and wherein the at least one object is configured to be released from the at least one tube when movable member is in the second condition.

7. The apparatus according to claim 4 wherein the at least one object is configured to be released from the at least one tube under the effects of gravity acting on the at least one object or under the effects of a fluid stream acting on the at least one object or under the effects of a fluid stream flowing through the mandrel inlet and outlet when the movable member is the second condition.

8. The apparatus according to claim 4 wherein the at least one object is pre-loaded into the at least one tube prior to use.

9. The apparatus according to claim 1 wherein the movable member comprises a ring, disc, wheel, cylinder, sphere, sleeve, chamber and/or a valve member.

10. The apparatus according to claim 1 wherein the bore is a diametric bore.

11. The apparatus according to claim 1 wherein the movable member is rotatable around a rotational axis transverse to the longitudinal axis of the mandrel.

12. The apparatus according to claim 1 wherein the mandrel inlet and outlet are in axial alignment.

13. The apparatus according to claim 1 wherein the movable member is located between the mandrel inlet and the mandrel outlet.

14. The apparatus according to claim 1 wherein the at least one object is selected from the group comprising a dart, ball, drift, RFID tag or plug.

15. The apparatus according to claim 1 wherein the movable member is configured to form a seal with the inlet and/or the outlet when in the first condition to stop flow into a tubular string.

16. The apparatus according to claim 1 wherein the movable member is configured to stop flow from above the inlet and/or below the outlet in the first condition.

17. A method of performing a cementing operation, the method comprising:

providing an apparatus according to claim 1 connected to a tubular string;

inserting at least one object into the bore; and moving the member relative to the mandrel between the first condition in which the bore is not aligned with the mandrel outlet and the second condition in which the bore is aligned with the mandrel outlet; and pumping cement into the inlet, movable member bore and through the outlet subsequent to moving the movable member to the second condition.

18. The method according to claim 17 comprising moving the member back to the first condition and inserting a further object into the bore and moving the member to the second condition to drop the further object into the tubular string.

19. A method of dropping at least one object into a wellbore tubular string, the method comprising:

providing a head apparatus connected to a tubular string; the head apparatus comprising:

a housing comprising an access port;

a mandrel having an inlet and an outlet wherein the outlet is connected to the tubular string; and a movable member comprising a bore;

inserting at least one object into the bore; and moving the member relative to the mandrel between a first condition in which the bore is not aligned with the mandrel outlet and the bore is aligned with the access port and is configured to receive the at least one object through the access port and a second condition in which the bore is aligned with the mandrel outlet and the access port is sealed by the movable member, wherein the movable member is configured to form a seal with the inlet and/or the outlet when in the first condition; and wherein the movable member is configured to prevent fluid egress through the access port during movement of the movable member between the first condition and the second condition.

20. The method according to claim 19 comprising moving the movable member from the second condition to the first condition prior to inserting the at least one object into the bore.

21. The method according to claim 19 comprising stopping fluid flow into or through the inlet prior to moving the movable member relative to the mandrel between the first condition in which the bore is not aligned with the mandrel outlet and the second condition in which the bore is aligned with the mandrel outlet.

22. The method according to claim 19 comprising inserting the at least one object into the bore while the movable member is in the first condition.

* * * * *